US007269977B1

(12) United States Patent
Pai

(10) Patent No.: US 7,269,977 B1
(45) Date of Patent: Sep. 18, 2007

(54) FLOSS BLOWING AND HEAT DISSIPATING APPARATUS FOR HIGH SPEED CIRCULAR KNITTING MACHINES

(75) Inventor: Tieh-Hsiung Pai, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/541,585

(22) Filed: Oct. 3, 2006

(51) Int. Cl.
*D05B 35/32* (2006.01)

(52) U.S. Cl. ..... 66/168

(58) Field of Classification Search ..... 66/8, 66/168, 114, 79, 115
See application file for complete search history.

(56) References Cited

U.S. PATENT DOCUMENTS 5,737,942 A * 4/1998 Gutschmit ..... 66/168
6,199,408 B1 * 3/2001 Shibata ..... 66/8
7,036,340 B1 * 5/2006 Chen ..... 66/8
7,043,941 B2 * 5/2006 Willmer et al. ..... 66/168

* cited by examiner

*Primary Examiner*—Danny Worrell
(74) *Attorney, Agent, or Firm*—Birch, Stewart, Kolasch, & Birch, LLP

(57) ABSTRACT

A floss blowing and heat dissipating apparatus for high speed circular knitting machines includes an annular duct located beneath a circular frame plate and an airflow generator to generate pressurized air. The annular duct has a passage inside and an air intake connector located thereon communicating with the passage, and a plurality of air vents close to a cylinder and straddle seats communicating with the passage. The airflow generator generates the pressurize air which is delivered to the air intake connector through an air directing hose so that the passage delivers the pressurized air to the air vents to eject the pressurized air forcefully towards the straddle seats, the cylinder and needles of a circular knitting machine where the floss is most likely to accumulate to carry away the floss. It also can reduce the temperature generated by the friction between needle troughs and needles to achieve optimal cooling effect.

17 Claims, 9 Drawing Sheets

FLOSS BLOWING AND HEAT DISSIPATING APPARATUS FOR HIGH SPEED CIRCULAR KNITTING MACHINES

BACKGROUND OF THE INVENTION

Field of the Invention

The present invention relates to a floss blowing and heat dissipating apparatus and particularly to a floss blowing and heat dissipating apparatus for circular knitting machines.

Operation of a conventional circular knitting machine generally includes the steps of yarn supplying, knitting and fabric winding. During knitting operation the cylinder rotates about the center of the circular knitting machine. There are cams surrounding the cylinder that have tracks to direct needles located in the needle troughs of the cylinder to move up and down. Meanwhile sinkers are moved forwards corresponding to the needles to proceed knitting operation. In order to smooth knitting operation, the supplying yarns must be stretched tightly. The yarns often generate lints or floss during operations of yarn sinking, yarn directing and yarn feeding. If the floss is not removed, it tends to clog various elements of the circular knitting machine and affect the smoothness of knitting operation, and even shorten the life span of the circular knitting machine. Moreover, if the floss and the yarns are woven into the fabric, fabric defects are formed and fabric quality is impacted. In addition, during knitting operation, constant friction occurs between the needles and the troughs of the cylinder, and a high temperature over 90 degrees is often generated. Such a high temperature causes heat expansion that affects operation of various elements. The yarns also could not withstand such a high temperature and result in yarn rupturing and defective finished products.

To remedy the aforesaid problems, many floss blowing or heat dissipating apparatus have been developed. For instance, U.S. Pat. No. 5,737,942 entitled "MEANS FOR DETERRING LINT AND DEBRIS ACCUMULATION OF THE KNITTING ELEMENTS OF A CIRCULAR KNITTING MACHINE" has a curved plate interposed between a horizontal frame plate and a circular frame plate and a straddle seat to form an air chamber. Through an air pump and an air supply hose, pressurized air is delivered into the air chamber. The pressurized air is dispersed naturally to the cylinder and other elements through an annular gap formed between the straddle seat and the circular frame plate to blow away the floss and achieve cooling effect. While the conventional technique mentioned above can blow away the floss and disperse heat, it still has drawbacks remained to be overcome, notably the pressurized air has to fill the air chamber before blowing to the cylinder through the annular gap above the straddle seat. As the air chamber is closed on three sides and open on an upper side (the upper side of the straddle seat being open), the pressurized air is dispersed through the gap above the straddle seat and lost before the air chamber is filled. Hence the effect of floss blowing and cooling is not desirable. The air pump has to be operated at the maximum capacity to generate more pressurized air faster to achieve the desired result. This causes overloading of the air pump. With the circular knitting machine operating at a long period of time, overloading of the air pump generates high temperature and shortens the lift span. Therefore it takes a higher cost to meet the purpose of floss blowing and cooling. It does not make economic sense. Another U.S. Pat. No. 6,199,408 entitled "Cooling apparatus for knitting components" includes a cover located between an intermediate ring and a lower ring, and a cylinder chamber formed between a needle-selecting actuator and the cover. There is a ventilator fan located on the cover to draw external air into the chamber. Channeling by an opening of the chamber, heat generated on the cylinder and the surrounding operation elements can be dispelled. However it also has drawbacks same as U.S. Pat. No. 5,737,942, but fares even worse in terms of the effect of floss blowing and cooling. All the problems occurred to the conventional techniques, such as poor floss blowing and cooling effect, and overloading of the air pump, are still pending to be resolved.

SUMMARY OF THE INVENTION

Therefore the primary object of the present invention is to solve the aforesaid disadvantages. The present invention provides a floss blowing and heat dissipating apparatus for high speed circular knitting machines. It has a plurality of air vents to converge pressurized air to generate strong airflow to blow away the floss from the locations that are most likely to accumulate such as the straddle seats, cylinder and needles. Thereby usage of the pressurized air can be reduced, and life span of the airflow generator can be extended. Temperature generated due to friction between the cylinder troughs and needles is lower. An optimal cooling effect can be achieved.

To achieve the foregoing object, the floss blowing and heat dissipating apparatus for high speed circular knitting machines according to the invention has a cylinder in a circular knitting machine rotating about a spindle in the center. The cylinder has a plurality of needle troughs. Each needle trough holds a needle or a sinker. The cylinder is surrounded by a circular frame plate mounted onto a frame plate bracket and a plurality of straddle seats mounted onto a horizontal frame plate. Each of the straddle seats has a cam to guide and direct the needle to move up and down to perform knitting operation. The floss blowing and heat dissipating apparatus includes an airflow generator to generate pressurized air which is delivered through an air directing hose, and a plurality of annular ducts located on the periphery of the cylinder and the straddle seats. The annular ducts have a passage with openings on two ends and a plurality of air vents close to the cylinder and the straddle seats. The air vents communicate with the passage. At least one air intake connector is provided to bridge the annular ducts to channel the pressurized air to the passage. Thereby the pressurized air can be ejected through the air vents and blow forcefully towards the straddle seats, cylinder and needles to carry away the floss and heat accumulated thereon.

The foregoing, as well as additional objects, features and advantages of the invention will be more readily apparent from the following detailed description, which proceed with reference to the accompanying drawings.

DETAILED DESCRIPTION OF THE PREFERRED EMBODIMENTS

Figure 1:
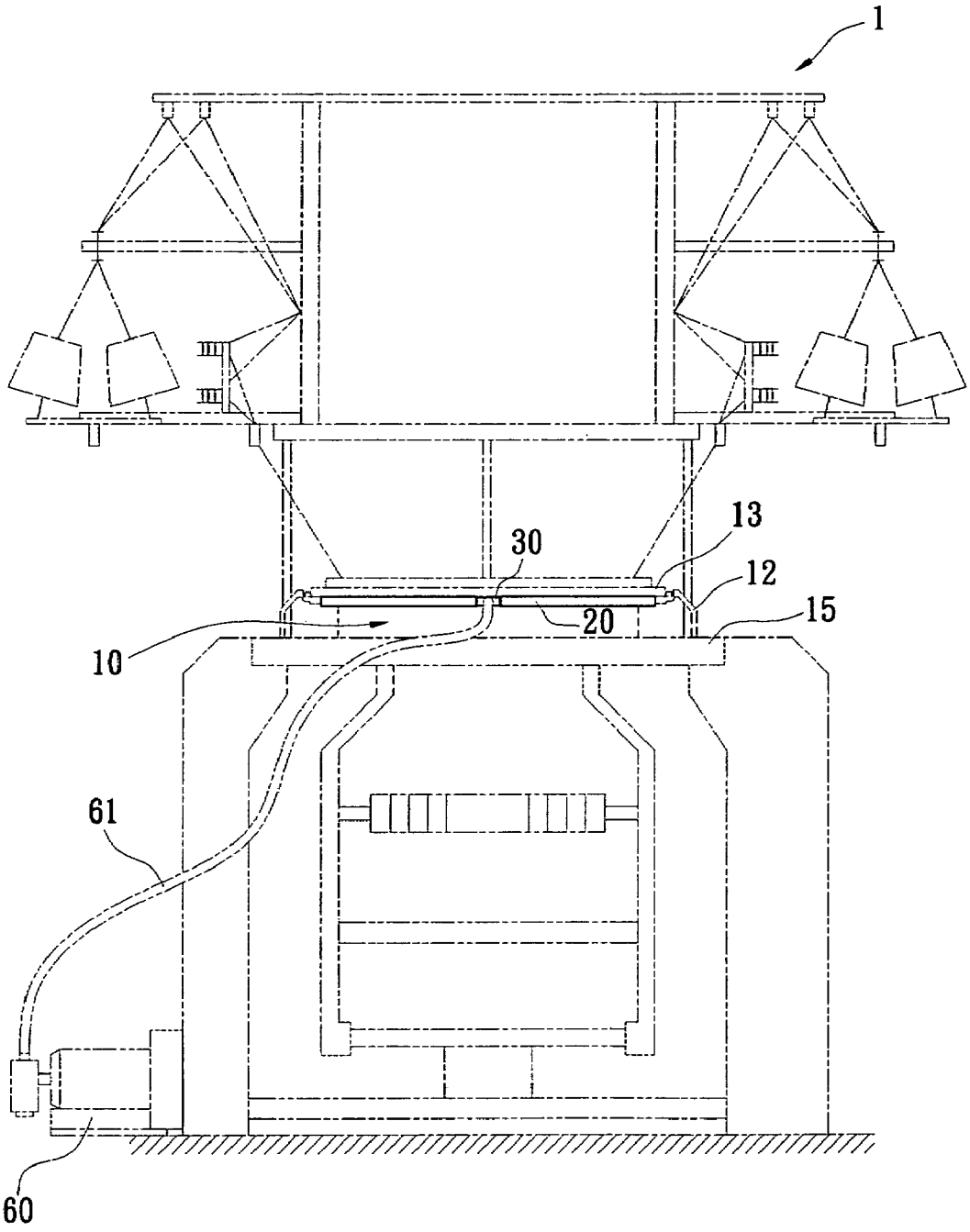
FIG. 1 is a plane view of the invention installed on a high speed circular knitting machine.
Figure 2:
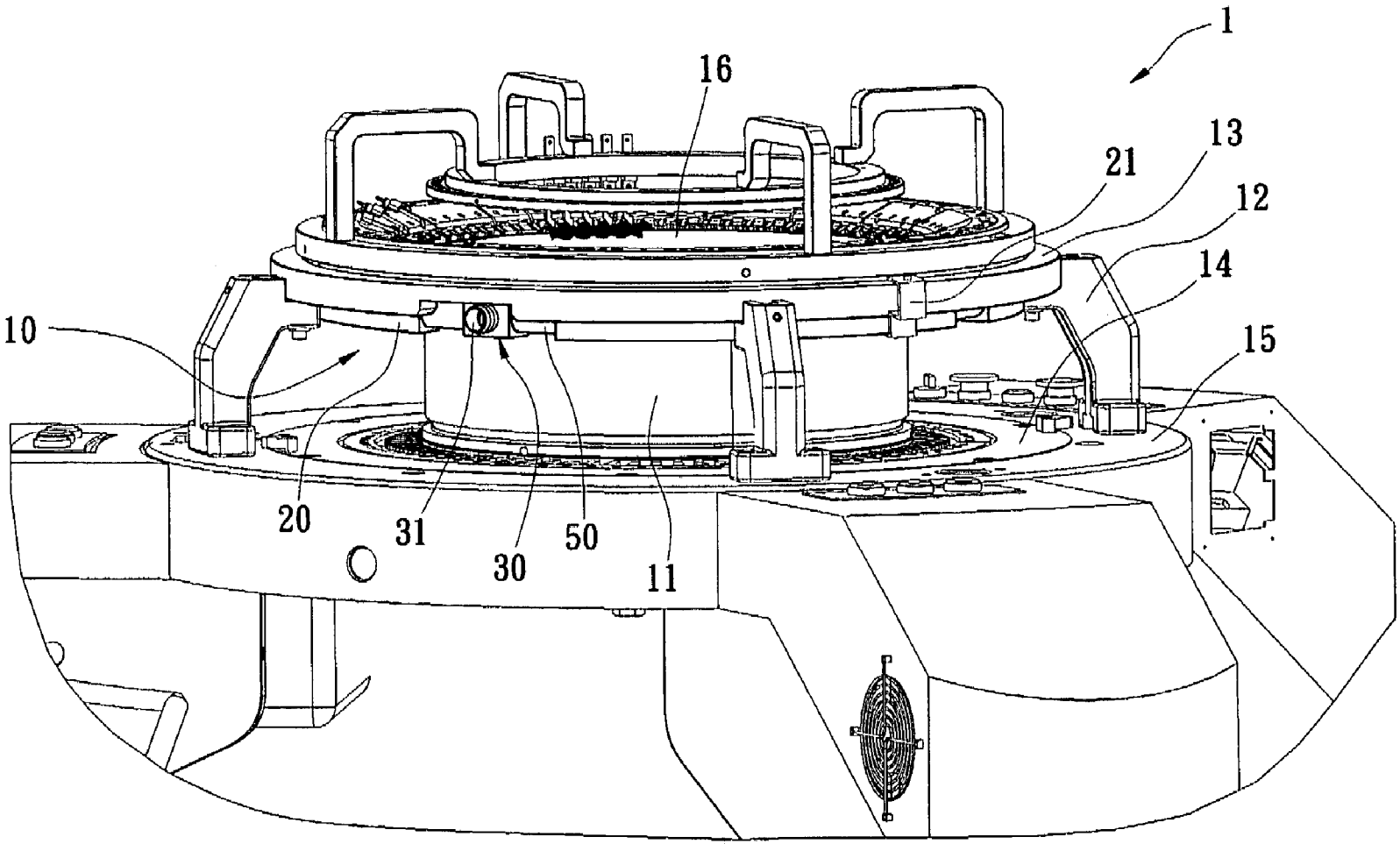
FIG. 2 is a fragmentary perspective view of a first embodiment of the invention.
Figure 3:
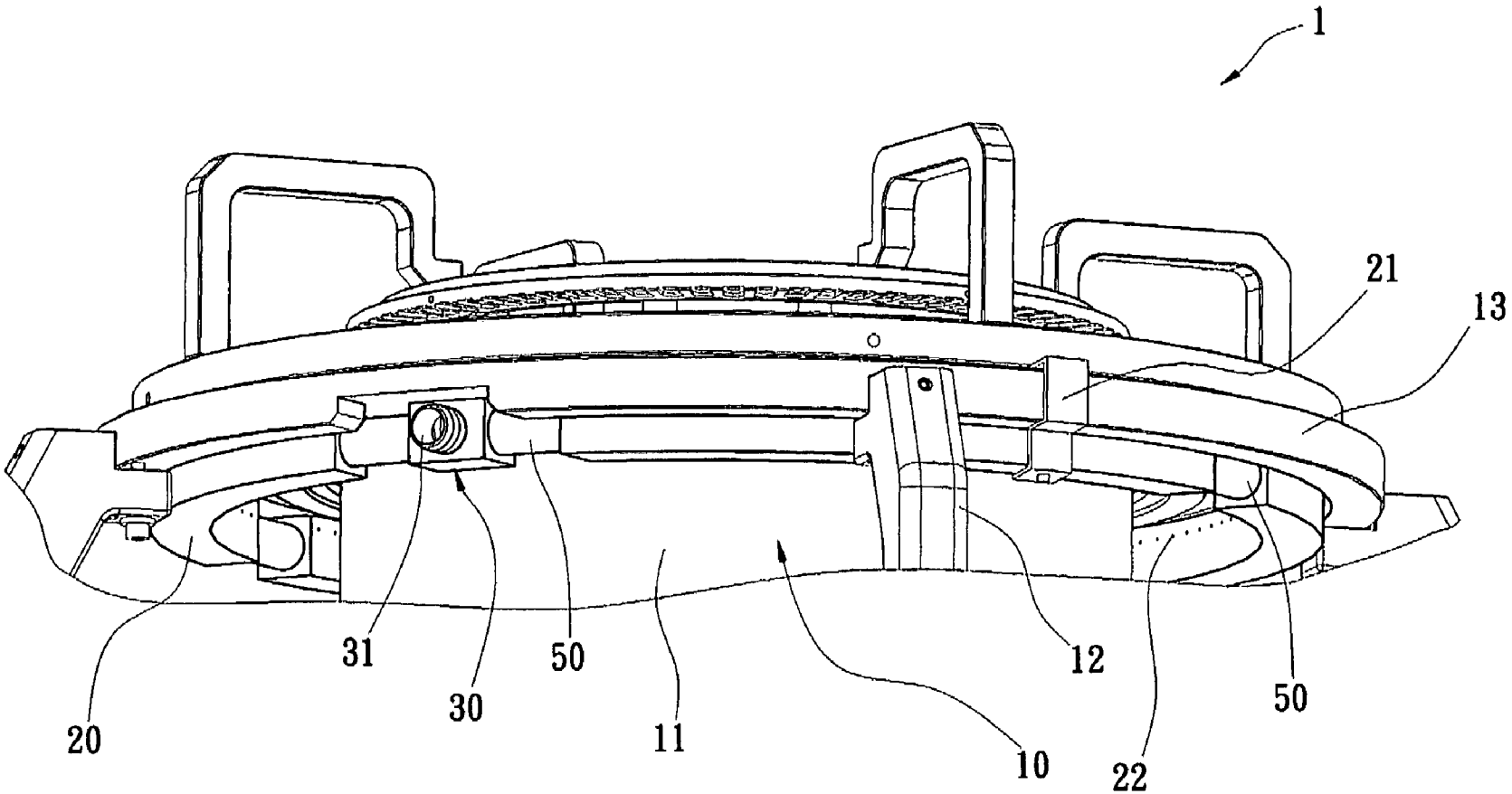
FIG. 3 is another fragmentary perspective view of the first embodiment of the invention viewing from another angle.
Figure 4:
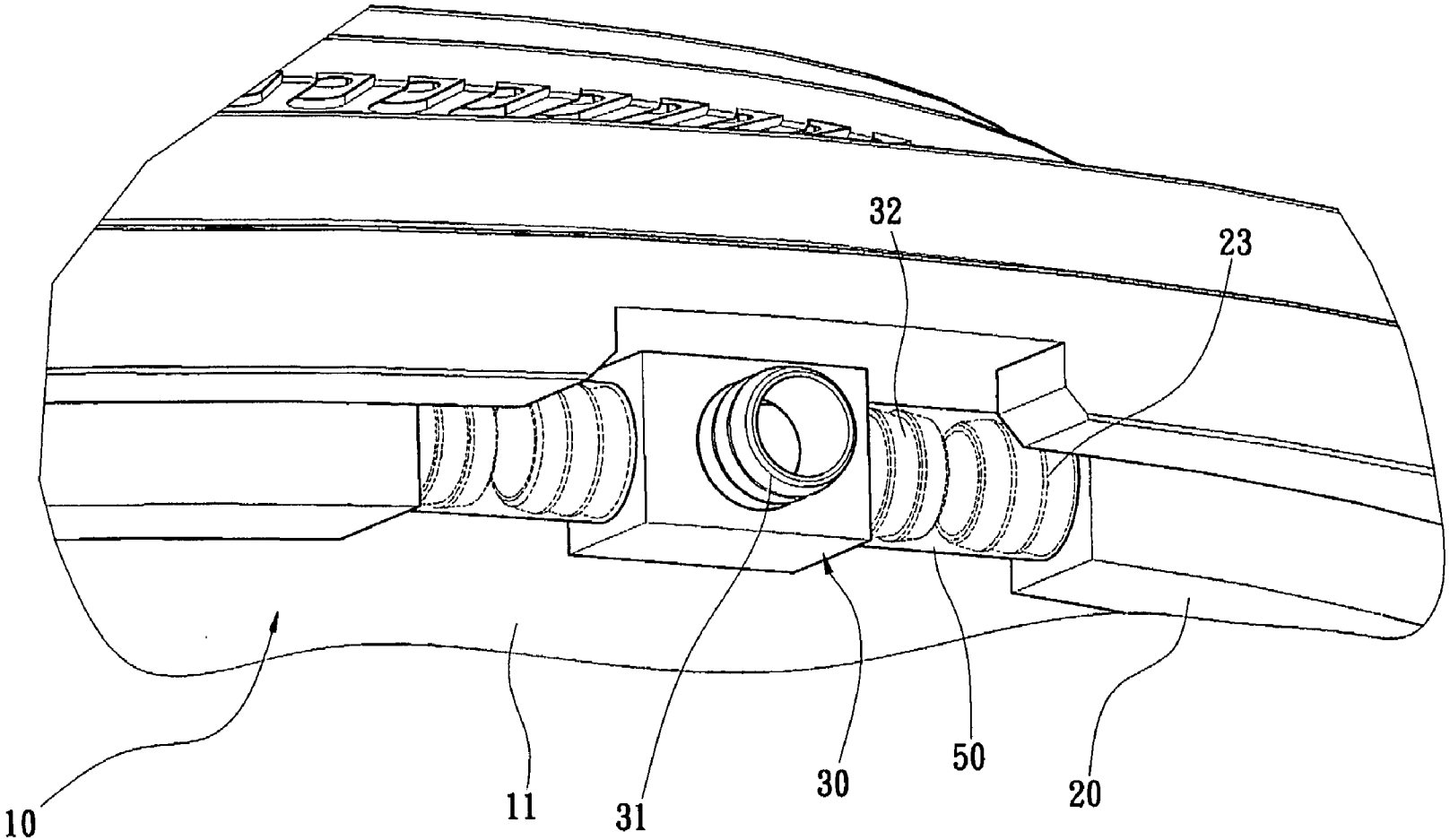
FIG. 4 is a fragmentary perspective view of the first embodiment of the invention showing the air intake connector and the annular duct in a connecting condition.
Figure 5:
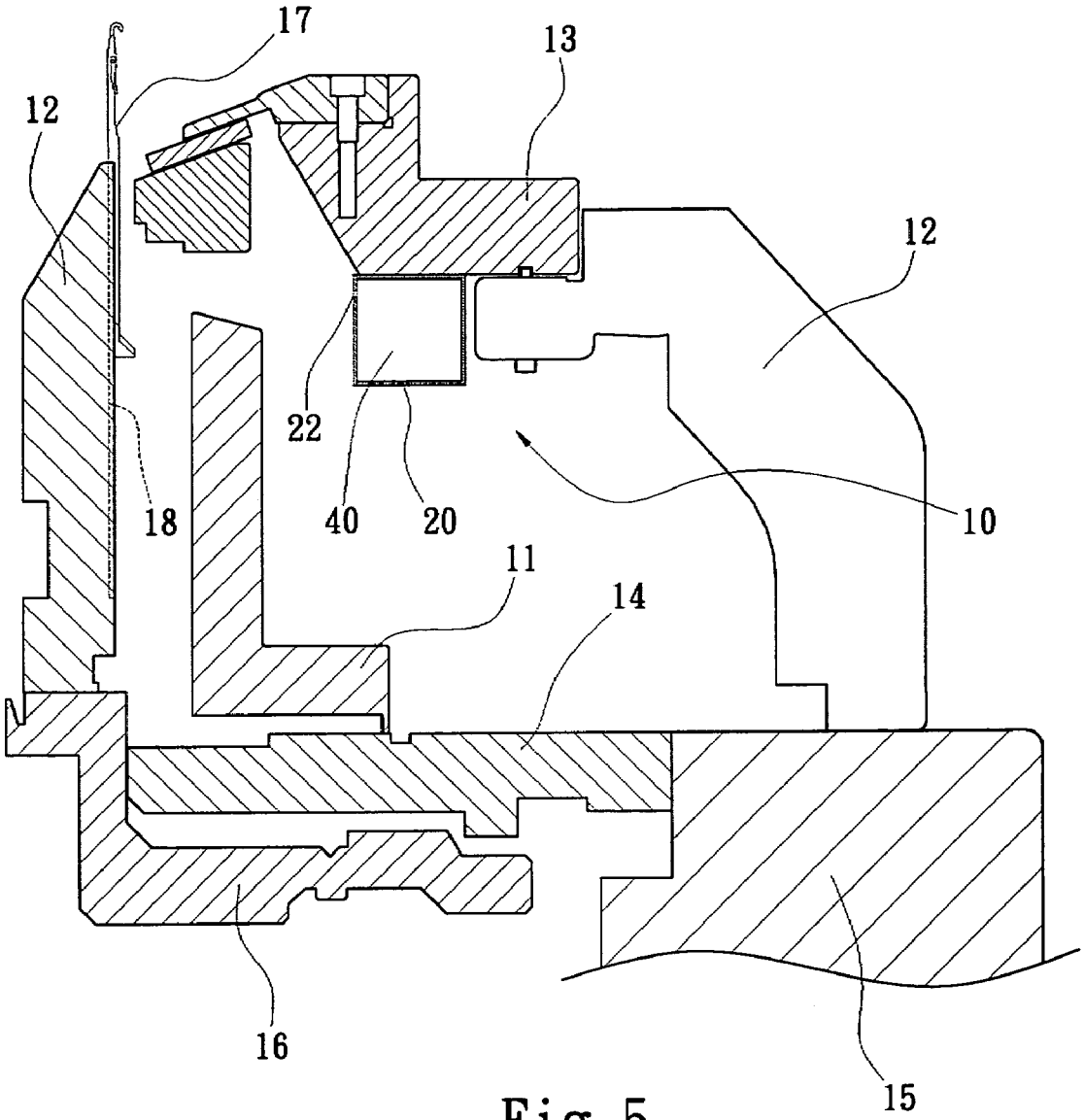
FIG. 5 is a fragmentary sectional view of the first embodiment of the invention showing the annular duct and surrounding facilities.
Figure 6:
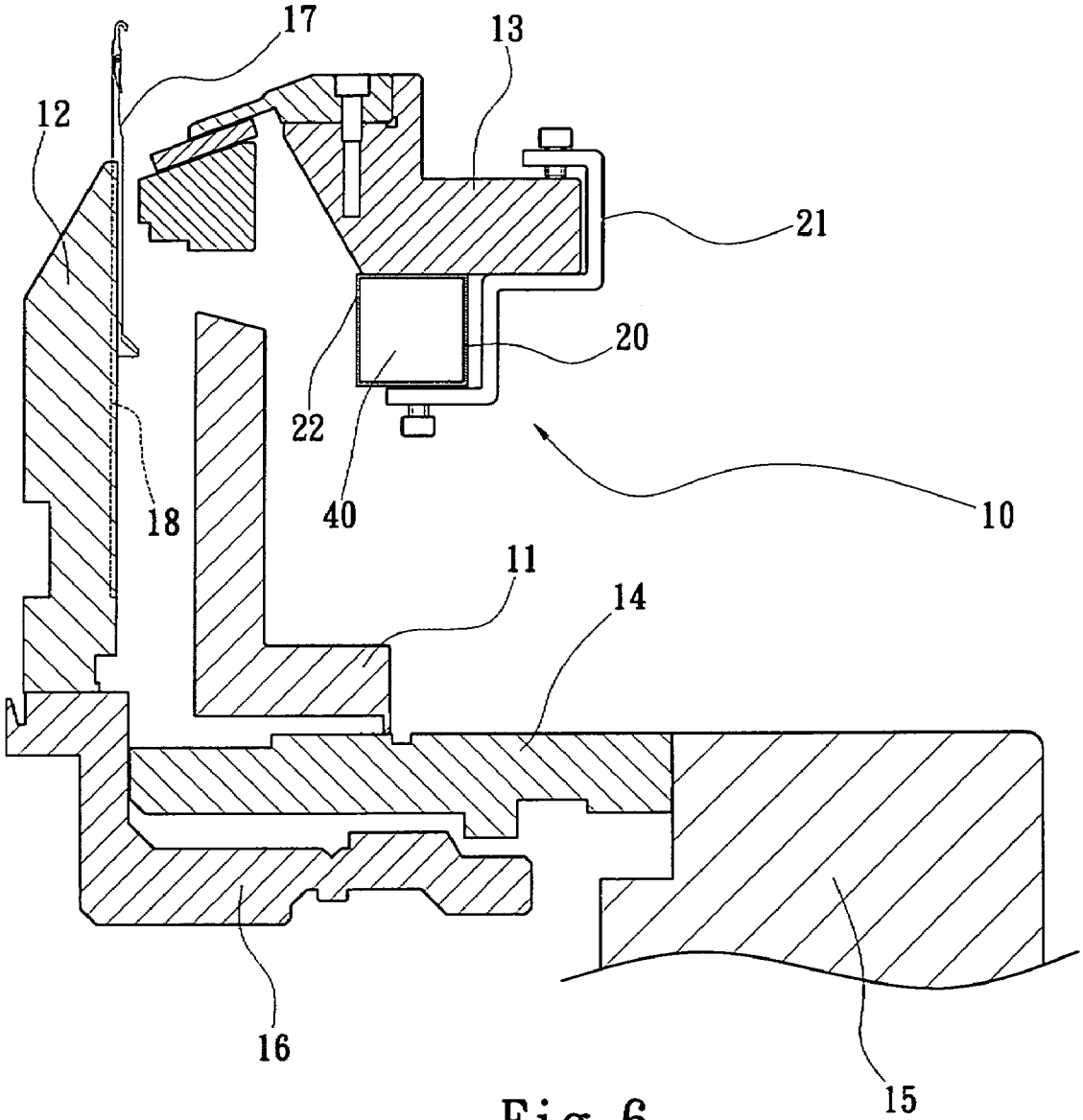
FIG. 6 is a fragmentary sectional view of the first embodiment of the invention showing the fastening structure of the annular duct.

Please refer to FIGS. 1 through 6 for a first embodiment of the floss blowing and heat dissipating apparatus of the invention. The circular knitting machine 1 has a cylinder 16 which can rotate about a center spindle. The cylinder 16 has a plurality of needle troughs 18, and each of needle troughs 18 holds a needle 17 or a sinker (not shown in the drawings). The cylinder 16 is surrounded by a circular frame plate 13 mounted onto a frame plate bracket 12 and a plurality of straddle seats 11 mounted onto a horizontal frame plate 14. The frame plate bracket 12 is mounted onto a holding ring 15. Each of the straddle seats 11 has a cam (not shown in the drawings). When the cylinder 16 rotates, the cam drives the needle 17 up and down to perform knitting operation. The floss blowing and heat disispating apparatus 10 includes an airflow generator 60 which may be a blower or air pump to generate pressurized air to be delivered through an air directing hose 61, a plurality of annular ducts 20 which are located on the periphery of the cylinder 16 and straddle seats 11, and mounted beneath the circular frame plate 13 through an anchor rack 21. The annular ducts 20 have a passage 40 with two open ends. The annular ducts 20 close to the cylinder 16 and straddle seats 11 have a plurality of air vents 22 communicating with the passage 40. At least one air intake connector 30 is provided to bridge the annular ducts 20. The air intake connector 30 has an air inlet 31 to channel the pressurized air into the passage 40. The junctures of the air intake connector 30 and the annular ducts 20 have connection ports 32 and 33 that are coupled through a connection duct 50 (referring FIG. 4). Aside from connecting the annular ducts 20 through the air intake connector 30, they also may be coupled directly through the connection duct 50. By means of the construction set forth above, the pressurized air can be ejected forcefully through the air vents 22 towards the straddle seats 11, cylinder 16 and needles 17 to carry away the accumulating floss and heat.

Figure 7:
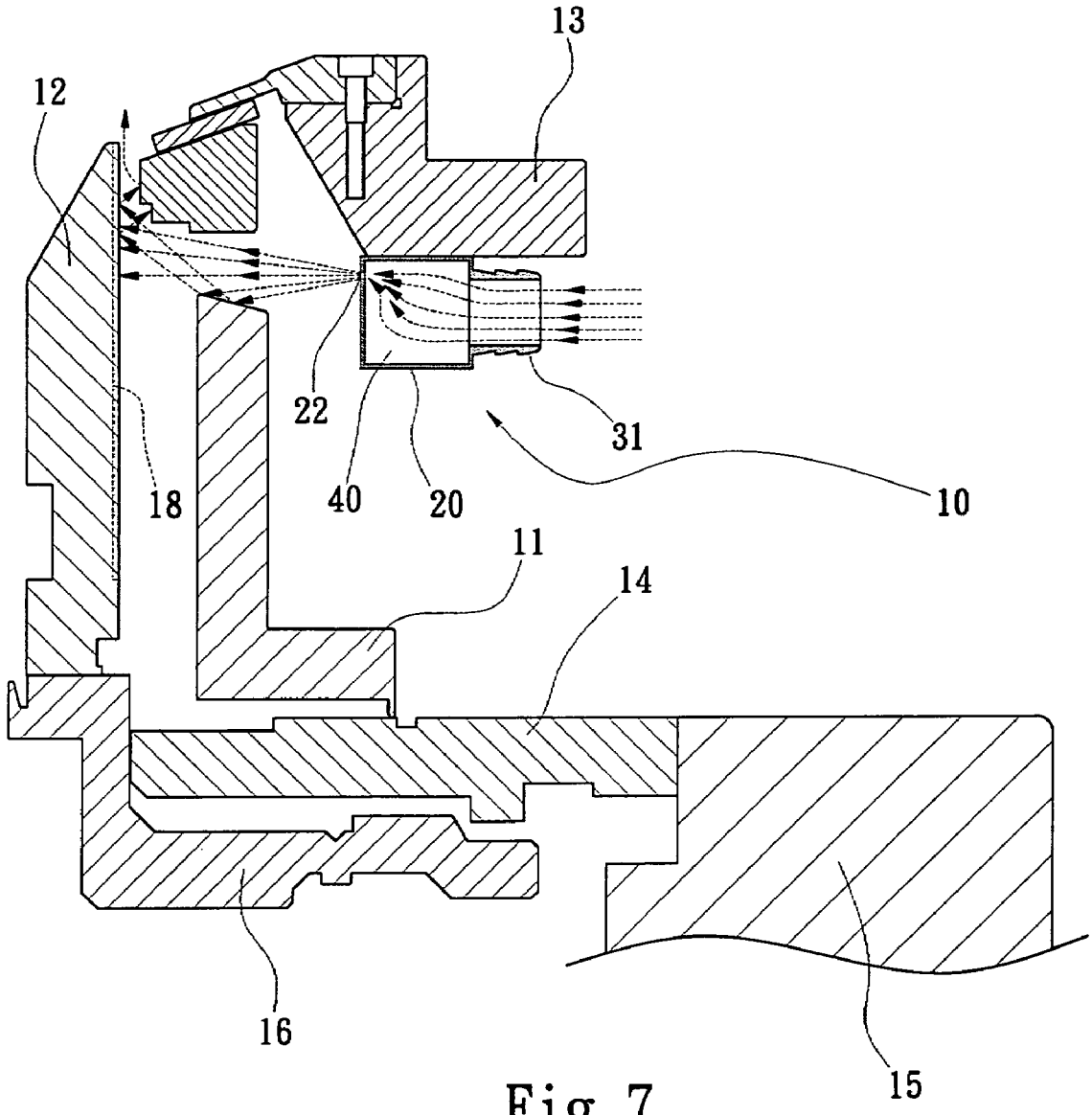
FIG. 7 is a fragmentary sectional view of the first embodiment of the invention showing air intake and air ejection of the annular duct.

Refer to FIG. 7 for air intake and ejection of the annular ducts in the first embodiment. The pressurized air ejected through the air vents 22 mainly is directed to an upper inclined surface of the straddle seats 11 so that the pressurized air can be refracted upwards towards the cylinder 16 and needles 17 to carry away the floss and heat accumulating on the straddle seats 11, cylinder 16 and needles 17.

Figure 8:
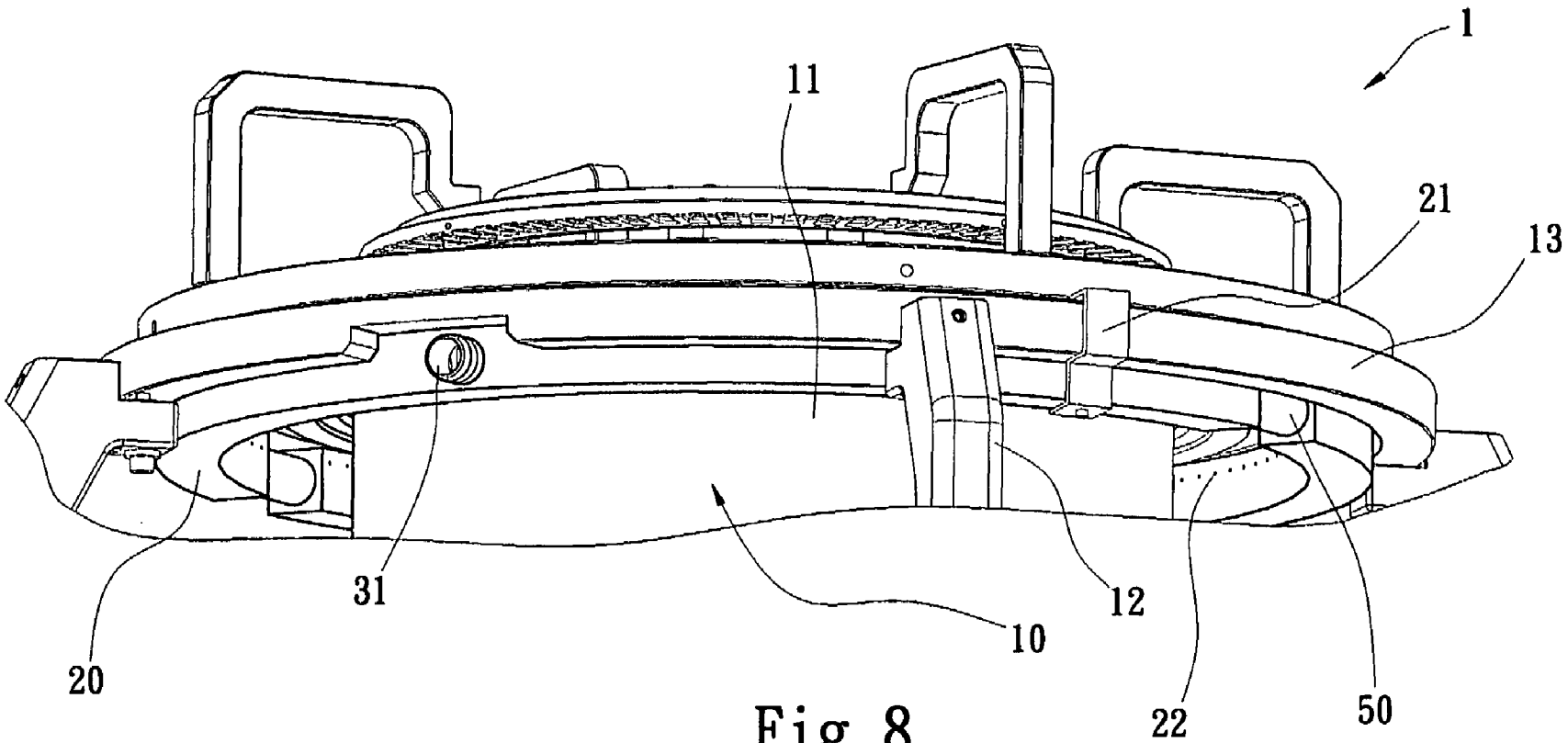
FIG. 8 is a fragmentary perspective view of a second embodiment of the invention.

Refer to FIG. 8 for a second embodiment of the invention that is covered by claim 7 hereunder. It differs from the first embodiment by directly forming the air inlet 31 on one annular duct 20, and the annular ducts 20 are coupled tightly by a connection duct 50. Hence the pressurized air can be ejected forcefully through the air vents 22 towards the straddle seats 11, cylinder 16 and needles 17 to carry away the floss and heat accumulating thereon.

Figure 9:
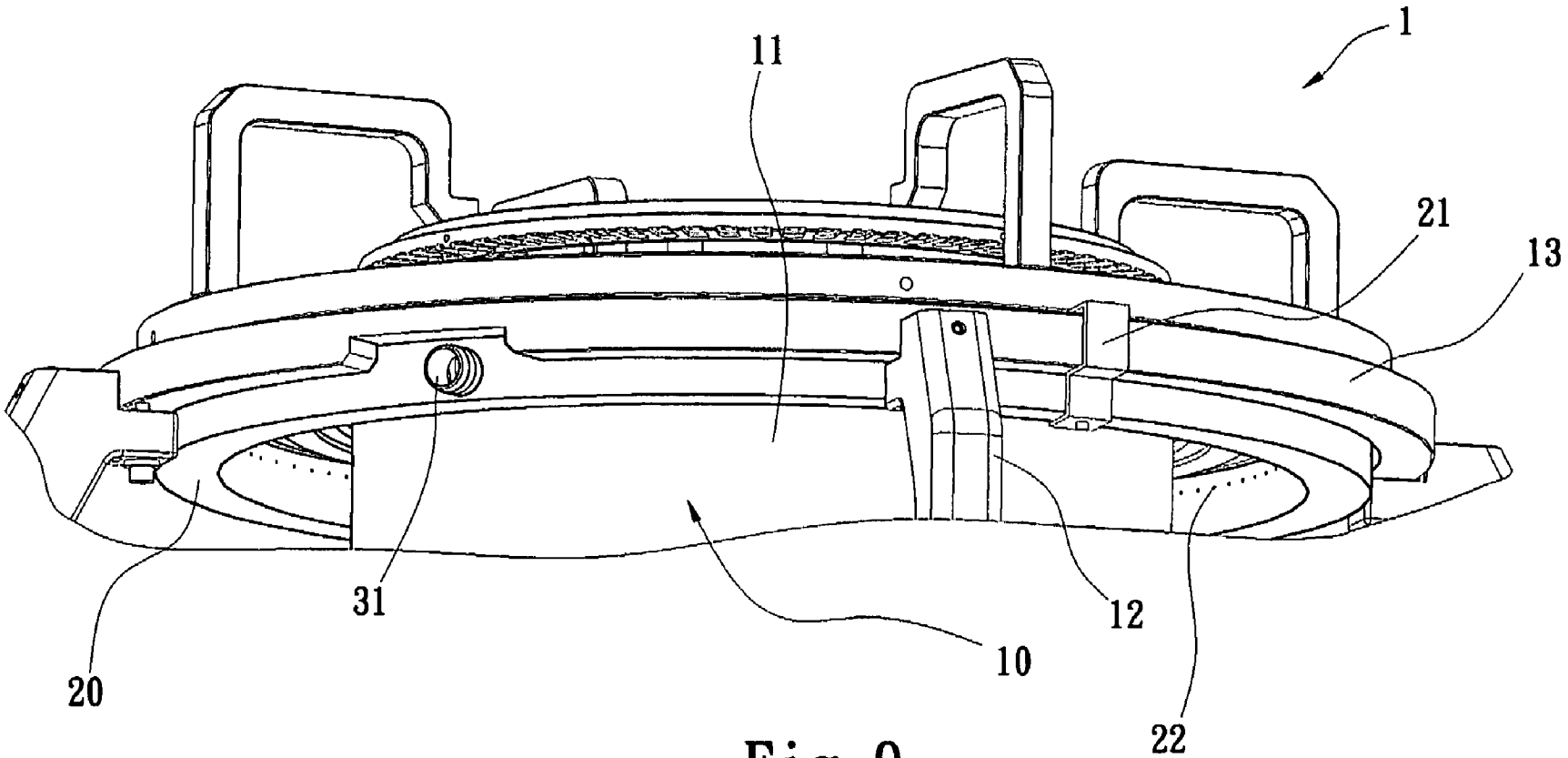
FIG. 9 is a fragmentary perspective view of a third embodiment of the invention.

Refer to FIG. 9 for a third embodiment of the invention that is covered by claim 11 hereunder. It differs from the first embodiment by having only one annular duct 20 beneath the circular frame plate 13. The annular duct 20 also has an air inlet 32 to channel the pressurized air to the air vents 22 for ejection forcefully towards the straddle seats 11, cylinder 16 and needles 17 to carry away the floss and heat accumulating thereon.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A floss blowing and heat dissipating apparatus for a high speed circular knitting machine which has a cylinder rotating about a center spindle, the cylinder having a plurality of needle troughs, each of needle troughs holding a needle or a sinker, and being surrounded by a circular frame plate mounted onto a frame plate bracket and a plurality of straddle seats mounted onto a horizontal frame plate, each of the straddle seats having a cam to drive the needle up and down while the cylinder rotates to perform knitting operation, the floss blowing and heat dissipating apparatus comprising:

an airflow generator to generate pressurized air which is delivered through an air directing hose;

a plurality of annular ducts which are located on the periphery of the cylinder and the straddle seats and have a passage which has two open ends, and have a plurality of air vents on the annular ducts close to the cylinder and the straddle seats communicating with the passage; and at least one air intake connector bridging the annular ducts and having an air inlet to channel the pressurized air to the passage;

wherein the pressurized air is ejected through the air vents to blow forcefully towards the straddle seats, the cylinder and the needle to carry away floss and heat accumulating thereon.

2. The floss blowing and heat dissipating apparatus of claim 1, wherein the air intake connector and the annular ducts are coupled through a connection duct.

3. The floss blowing and heat dissipating apparatus of claim 1, wherein the annular ducts are coupled through a connection duct.

4. The floss blowing and heat dissipating apparatus of claim 1, wherein the pressurized air ejected through the air vents is directed to an upper inclined surface of the straddle seats so that the pressurized air is reflected upwards towards the cylinder and the needle to carry away the floss and heat accumulating thereon.

5. The floss blowing and heat dissipating apparatus of claim 1, wherein the annular ducts are mounted beneath the circular frame plate through an anchor rack.

6. The floss blowing and heat dissipating apparatus of claim 1, wherein the airflow generator is a blower.

7. A floss blowing and heat dissipating apparatus for a high speed circular knitting machine which has a cylinder rotating about a center spindle, the cylinder having a plurality of needle troughs to hold respectively a needle or a sinker, and being surrounded by a circular frame plate mounted onto a frame plate bracket and a plurality of straddle seats mounted onto a horizontal frame plate, each of the straddle seats having a cam to drive the needle up and down while the cylinder rotates to perform knitting operation, the floss blowing and heat dissipating apparatus comprising:

an airflow generator to generate pressurized air which is delivered through an air directing hose;

a plurality of annular ducts which are located on the periphery of the cylinder and the straddle seats and have a passage which has two open ends, and have a plurality of air vents on the annular ducts close to the cylinder and the straddle seats communicating with the passage; and a plurality of connection ducts bridging the annular ducts and communicating with the passage;

wherein the pressurized air is ejected through the air vents to blow forcefully towards the straddle seats, the cylinder and the needle to carry away floss and heat accumulating thereon.

8. The floss blowing and heat dissipating apparatus of claim 7, wherein the pressurized air ejected through the air vents is directed to an upper inclined surface of the straddle seats so that the pressurized air is refracted upwards towards the cylinder and the needle to carry away the floss and heat accumulating thereon.

9. The floss blowing and heat dissipating apparatus of claim 7, wherein the annular ducts are mounted beneath the circular frame plate through an anchor rack.

10. The floss blowing and heat dissipating apparatus of claim 7, wherein the airflow generator is a blower.

11. A floss blowing and heat dissipating apparatus for a high speed circular knitting machine which has a cylinder rotating about a center spindle, the cylinder having a plurality of needle troughs to hold respectively a needle or a sinker, and being surrounded by a circular frame plate mounted onto a frame plate bracket and a plurality of straddle seats mounted onto a horizontal frame plate, each of the straddle seats having a cam to drive the needle up and down while the cylinder rotates to perform knitting operation, characterized in that the floss blowing and heat disispating apparatus comprises:

an annular duct located beneath the circular frame plate; and an airflow generator to generate pressurized air;

wherein the annular duct has a passage inside and an air inlet formed thereon communicating with the passage, and a plurality of air vents close to the cylinder and the straddle seats that communicate with the passage; the airflow generator generating pressurized air which is delivered to the air inlet through an air directing hose so that the passage delivers the pressurized air to the air vents to eject the pressurized air forcefully towards the straddle seats, the cylinder and the needle to carry away floss and heat accumulating thereon.

12. The floss blowing and heat dissipating apparatus of claim 11, wherein the pressurized air ejected through the air vents is directed to an upper inclined surface of the straddle seats so that the pressurized air is refracted upward towards the cylinder and the needle to carry away the floss and heat accumulating thereon.

13. The floss blowing and heat dissipating apparatus of claim 11, wherein the annular duct is mounted beneath the circular frame plate through an anchor rack.

14. The floss blowing and heat dissipating apparatus of claim 11, wherein the airflow generator is a blower.

15. The floss blowing and heat dissipating apparatus of claim 1, wherein the airflow generator is an air pump.

16. The floss blowing and heat dissipating apparatus of claim 7, where the airflow generator is an air pump.

17. The floss blowing and heat dissipating apparatus of claim 11, wherein the airflow generator is an air pump.

* * * * *